United States Patent [19]

Pagano et al.

[11] 4,036,104

[45] July 19, 1977

[54] LIGHTWEIGHT METHOD OF CONSTRUCTION FOR RIBBED APPLIQUE ARMOR

[75] Inventors: Victor H. Pagano, Rochester; Freeman O. Moore, Jr., Warren, both of Mich.

[73] Assignee: The United States Government as represented by the Secretary of the Army, Washington, D.C.

[21] Appl. No.: 658,546

[22] Filed: Feb. 17, 1976

[51] Int. Cl.[2] ..... F41H 7/04

[52] U.S. Cl. ..... 89/36 H

[58] Field of Search ..... 52/473; 109/9, 10, 11, 109/12, 13, 15, 58, 58.5, 49.5, 84; 160/DIG. 1; 180/68 R, 68 P; 89/36 R, 36 A, 36 H, 36 L

[56] References Cited

U.S. PATENT DOCUMENTS

| | | | |
|---|---|---|---|
| 1,761,095 | 6/1930 | Spottswood | 109/12 |
| 1,889,317 | 11/1932 | King | 109/10 |
| 2,376,331 | 5/1945 | Abrams | 89/36 H |
| 3,378,955 | 4/1968 | Wahlgren | 52/473 |
| 3,901,124 | 8/1975 | Hausenblas | 89/36 H |

*Primary Examiner*—Stephen C. Bentley

*Attorney, Agent, or Firm*—Peter A. Taucher; John E. McRae; Nathan Edelberg

[57] ABSTRACT

It is known to equip military vehicles with acutely angled louvers or slats mounted outboard of the vehicle walls to intercept enemy projectiles before such projectiles reach the vehicle; the louvers are desirably formed of hardened material to exert a fragmentization force on the projectiles. Under the present invention the louvers are specially connected and mounted to reduce weight without sacrificing ballistic effectiveness.

3 Claims, 2 Drawing Figures

LIGHTWEIGHT METHOD OF CONSTRUCTION FOR RIBBED APPLIQUE ARMOR

The invention described herein may be manufactured, used, and licensed by or for the Government for governmental purposes without payment to us of any royalty thereon.

BACKGROUND AND SUMMARY OF THE INVENTION

U.S. Pat. No. 3,765,301 issued in the name of Victor Pagano and Harry Spiro discloses a ballistic louver module comprising a flat steel base plate 14 having louvers 12 attached thereto by welding. The flat steel base plate undesirably adds considerable weight to the module, especially if the plate is to have sufficient thickness to withstand excessive heat distortion stresses incident to the louver welding operations. Reliance on welding as a joining method is disadvantageous in that it undesirably limits the choice of louver materials to those which can be readily fabricated by such a method. In the case of steel, high hardness medium carbon material (0.4%C) is not readily fabricated by welding procedures. Also, welding reduces hardness in the heat-affected areas. The present invention contemplates a louver assembly method that avoids use of welding.

Similarly, U.S. Pat. No. 3,265,299 issued in the name of Victor Pagano and Zygmunt J. Fabrykowski discloses an envelope or hollow panel member for holding armor elements. The envelope in this design can also add undesirable weight to the final armor panel used in vehicle application. The present invention provides louver modules that have lighter weights than the prior art modules while retaining substantially the same or better ballistic performance. Thus, on an equal protection basis the herein described method of construction provides a more effective armor design for vehicle application.

THE DRAWINGS

Figure 1:
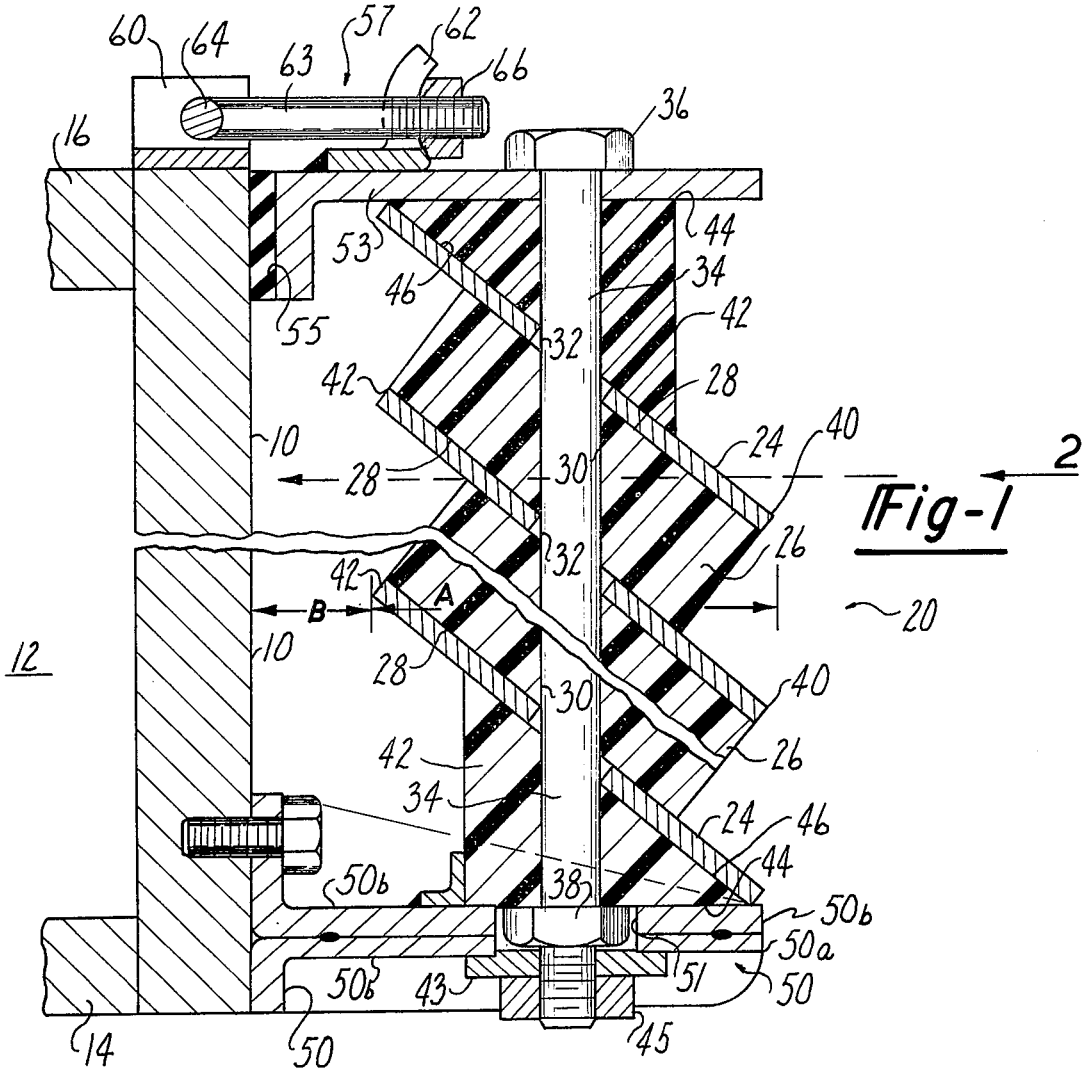
Figure 2:
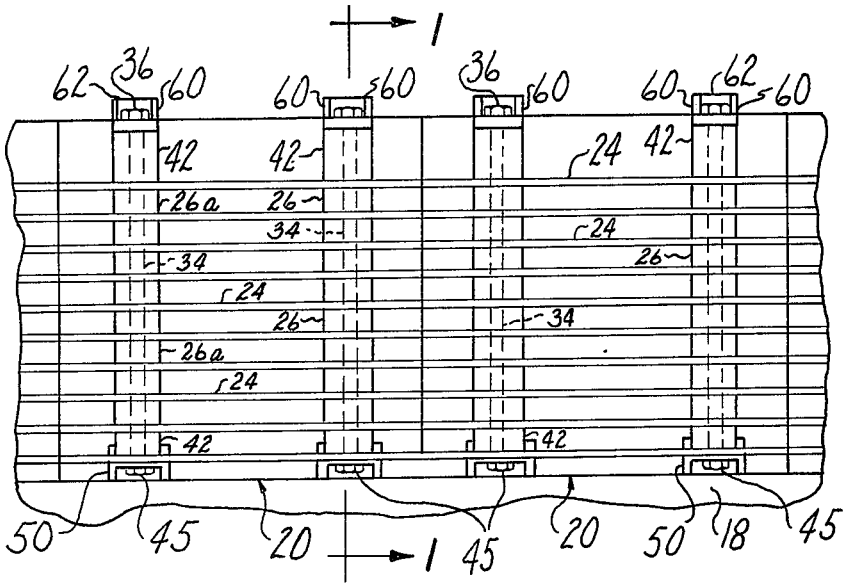

FIG. 1 is a fragmentary sectional view taken through a ballistic louver module constructed according to the invention. FIG. 1 is taken on line 1—1 in FIG. 2. FIG. 2 is a front view of two modules taken on a reduced scale. FIG. 2 is taken in the direction of arrow 2 in FIG. 1. FIG. 1 shows one upright side wall 10 of an armored personnel carrier, e.g. the U.S. Army's tracked vehicle designated as the M-113. Space 12 to the left of wall 10 would be occupied by troops sitting on benches or seats mounted on horizontal wall 14 within the vehicle. Roof 16 of the vehicle is spaced a suitable distance above wall 14 to accommodate the seated troops. Walls 10, 14 and 16 are in one instance formed of light weight aluminum armor plate about 1½inches thick.

The external space to the right of wall 10 is occupied by a number of louver modules 20, each module being comprised of a number of spaced hardened steel louvers acutely angled to wall 10 to intercept enemy projectiles fired in the arrow 2 direction. FIG. 2 shows two louver modules 20, plus portions of two other modules. The modules are arranged contiguous to one another along the full length of each wall 10. Other louver modules may be arranged on the vehicle front and rear walls, as deemed necessary or feasible. Each louver module is preferably removable or replaceable, as for example after battle damage. Therefore the weight of each module is limited to the weight that can be handled by one or two men; preferably the module weight should be kept below one hundred pounds to permit field replacement by two men without hoists or other special tools or fixtures. In a typical situation a representative module might be approximately 36 inches high by 24 inches wide.

Each louver module comprises flat parallel louvers 24 formed of steel or other ballistic material. The louvers are interconnected at discrete points therealong by two sets of spacer blocks 26 and **26*a*, preferably formed of light weight non-metallic material (e.g. polyethylene) or metallic material (e.g. aluminum). Each spacer block has flat parallel faces 28 engaging the major faces of the individual louvers 24. Circular holes 30 are drilled or otherwise formed through blocks 26 or 26*a* at acute angles to the parallel faces 28. The holes may be drilled or molded through individual blocks; alternatively a single hole may be drilled through an elongated bar, after which the bar may be sliced into spacer block sections. Mating holes 32 are formed in the aligned portions of the louvers. Extending through each set of aligned holes is an elongated tie bolt 34 having a head 36 at its upper end. The lower threaded end of the bolt receives a clamping nut 38. Triangular end blocks 42 are located between the clamping head 36 (or nut 38) and each endmost louver 28. Each end block 42 has a base surface 44 extending normal to the axis of bolt 34, and an inclined louver-contact surface 46 extending at an acute angle to the bolt axis. The angularity between surfaces 44 and 46 corresponds to the angularity of each hole 30 (relative to block surface 28) such that the louvers are maintained in the desired angular positions when a tightening force is applied to each nut 38**.

Each louver module 20 is preferably mounted in a removable fashion outboard from armor plate 10. Various mounting mechanisms can be devised to achieve the desired results. As illustratively shown in the drawings, the mount mechanism comprises two similar bracket arms 50 for preventing tilt-out movement of the module. Two bracket arms 50 are permanently bolted to wall 10 to underlie the two lowermost blocks 42 when the louver module is manually lowered onto the brackets. A washer 43 and nut 45 may be located and tightened on the lower end of each bolt 34 to prevent upward pull-out of the louver module from brackets 50; nut 45 is unloosened to permit removal of the louver module. For attainment of desired rigidity each bracket 50 may be formed of two preformed angle elements **50*a* and 50*b* suitably welded together. A clearance hole 51 may be formed in each bracket to accommodate nut 38**.

Each louver module includes at its upper end two spacer plates 53 equipped with sound-reducer cushions 55 adapted to abut the face of wall 10. A spherically surfaced detent 62 is welded or otherwise affixed to each spacer plate 53 for cooperation with a latch mechanism 57 that is swingably carried by the vehicle. As shown, each latch mechanism commprises a longitudinal rod 63 extending from a transverse pivot pin 64 that is rotatably mounted in two parallel upstanding plates 60. The free end of rod 63 is threaded to receive a nut 66 having a conical end surface mating with the spherical surface of detent 62. The detent is bifurcated to permit rod 63 to be swung upwardly about the axis of pin 64 after nut 66 has been unloosened from the rod. Tightening the nut compresses cushion 55, which enables the cushion to retain the louver module against rattling. It will be understood that each module uses two latch mechanisms 57 for its retention on the vehicle. The weight of each louver module is borne by two brackets 50. Considerable variation may be made in the bracket structure and latch structure. However these structures should have a capability for spacing the louver module from the vehicle outer surface, as denoted by dimension B. The illustrated spacing B advantageously allows fragmented enemy projectiles to be dispersed before reaching armor plate 10. Dispersed fragments have lesser penetration abilities than concentrated fragments. Space B therefore improves the effectiveness of the louver-armor plate combination. Shelves 50 support the module weight while the user is operating the latches 57.

FIG. 1 shows the module as having three louvers 24. Actually each module would have more than three louvers, the exact number depending on the dimensions of wall 10 and the permissible module weight. The major portion of the module weight is due to the louvers. Assuming a louver thickness of ⅛ inch; and a louver width (from leading edge 40 to trailing edge 42) of 4 inches, each linear foot of louver would weigh about 1½ pounds. A louver module containing 24 louvers, each 2 feet in length, would have a total louver weight of about 72 pounds. The weight of the spacer blocks, tie bolts and mount brackets might bring the total module weight up to about 90 pounds, depending on the dimensions and density of this added hardware. To lighten the total mass the spacer blocks can be formed of molded polyethylene or similar high compression strength light weight material. The spacer blocks need not be very wide (as seen in FIG. 2), since the surface area of each block in the front-to-rear direction is substantial. The illustrated system uses minimum connector and attachment hardware, thus providing a desired compromise between total module weight and ballistic effectiveness.

The principal advantage of the illustrated louver module is its relatively low total weight, achieved because of the elimination of the mounting plate disclosed in aforementioned U.S. Pat. No. 3,765,301 or the envelope enclosure disclosed in U.S. Pat. No. 3,765,299. The illustrated louver connector mechanism 26, 34, 42 is considerably lighter than the earlier-used mounting plate or envelope.

Another advantage of the herein illustrated module design is the capability for selecting louver materials having optimum ballistic characteristics. This is due to the fact that the louvers are mounted and connected together without welding. As is known, not all materials are susceptible to reliable joinder by welding operations. Using the present invention, louver elements could be prepared from current low cost 500 BHN alloy (i.e., XAR30) steel, higher cost but harder (600 BHN) alloy steel (0.45%C), roll bonded dual hardness armor steel or any other effective material combination which offers the greatest projectile shattering effect for the least weight. This flexibility in choice of louver material is readily facilitated by the method of construction described herein. The present method provides a simplicity for rebuild or modification in the field similar to that described in U.S. Pat. No. 3,765,299, but without an excessive weight penalty.

A minor advantage may be realized under this invention by reason of the fact that blocks 26 can be manufactured and drilled to relatively precise dimensional tolerances. The blocks tend to maintain close control on the louver spacing and angularity. Additionally, the blocks and tie mechanisms can under some circumstances be assembled into the louvers quicker and at lower cost, compared to welding procedures. Each nuts 38 can be untightened in the event it is desired or necessary to replace damaged louvers within an otherwise usable module; on the other hand welded assemblies are not readily capable of louver replacement. Should it be desired to change the louver material, louver spacing or louver angularity (relative to the plane of plate 10), such change can be accomplished by using different spacer blocks 26 and end blocks 42.

The louver angularity shown in FIG. 1 is about 50° relative to wall 10 and about 40° relative to the expected horizontal projectile trajectory designated by arrow 2. This angularity is suitable when the louver module is used outside a vertical vehicle wall 10. However, some vehicles are provided with sloping or angled walls, either at the front of the vehicle or the sides or back. When the vehicle has a sloping external wall the louvers may be required to extend right angularly from the sloping wall in order to have a desired acute attack angle to enemy projectiles fired in the arrow 2 horizontal trajectory. The louver angle may be changed by using spacer blocks 26 or **26*a* having differently angled holes 30; e.g. in the "sloping wall" case holes 30 might be at right angles to block faces 28** so that the louvers angled upwardly and outwardly rather than upwardly and inwardly. Advantageously the same louvers can be used to provide different louver angles or inclinations.

It will be noted that in the illustrated arrangement the louvers are spaced outwardly from vehicle wall 10 by a distance B. Space B constitutes a projectile fragment dispersal zone that contributes to ballistic performance of the louver module. If we consider dimension A as the louver module width and dimension B as the fragment dispersal zone width then in a specific arrangement dimension A might measure about 3 inches and dimension B about 1 inch; dimension B should be at least one fourth dimension A. The louvers are preferably angled so that an enemy projectile fired in the arrow 2 horizontal trajectory must pass through two louvers, thus improving the chances for fragmentation of the projectile when it initially enters dispersal space B.

As previously noted, the principal advantage of this invention is the reduction in weight of the louver module achieved by the method of connecting the louvers together.

We wish it to be understood that we do not desire to be limited to the exact details of construction shown and described for obvious modifications will occur to a person skilled in the art.

I claim:

1. In a military vehicle having outer upright walls formed of armor plate:

the improvement comprising a series of louver modules mountable on external surfaces of the armor plate to intercept enemy projectiles directed toward the vehicle:

each louver module comprising a series of flat plate louvers (24) arranged in spaced parallel relation at an acute angle to the general plane of the module; at least two rows of spacer blocks (26 and **26*a*) interposed between adjacent ones of the louvers at spaced points therealong, said spacer blocks having parallel faces engaging the louver spacing; upper and lower triangular end blocks (42) having first surfaces thereof engaging face areas of the endmost louvers, and second surfaces thereof extending normal to the general plane of the module; tie bolts (34)** extending through aligned openings in the louvers and blocks; and nut means threaded onto the bolts to force the louvers tightly against the blocks;

and means for removably mounting each module on the vehicle without disconnecting the nut means from the tie bolts; each mounting means comprising a series of laterally spaced brackets (50) projecting from the vehicle outer walls to underlie the triangular end blocks and thereby carry the module weight; vehicle-engaging spacer means (53) carried by the module at its upper end for spacing the module from the vehicle external surface; and manually-operable latch means (57) operable to draw the module toward the vehicle surface, whereby said spacer means (53) and latch means (57) cooperably rigidify the module position.

2. In the vehicle of claim 1 said mounting means further comprising second nut means (45) threadable onto the tie bolts at the underside of each bracket (50) to clamp the module onto the brackets.

3. In the vehicle of claim 1 said spacer means (53) comprising plate elements positioned atop the uppermost end blocks (42) and retained thereon by the associated tie bolts.

* * * * *

UNITED STATES PATENT OFFICE

CERTIFICATE OF CORRECTION

Patent No. 4,036,104 Dated July 19, 1977

Inventor(s) Victor H. Pagano et al.

It is certified that error appears in the above-identified patent and that said Letters Patent are hereby corrected as shown below:

Column 2, line 56, "commprises" should read -- comprises --.

Column 4, line 63, after "louver" -- faces to define the louver -- should be inserted.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*